US009185986B2

(12) United States Patent
Marvin et al.

(10) Patent No.: US 9,185,986 B2
(45) Date of Patent: Nov. 17, 2015

(54) COUCH CATCHER

(71) Applicants: Andrew Michael Marvin, Bishop, CA (US); Heather Christine Marvin, Bishop, CA (US)

(72) Inventors: Andrew Michael Marvin, Bishop, CA (US); Heather Christine Marvin, Bishop, CA (US)

(73) Assignees: Andrew Marvin, Fallon, NV (US); Heather Marvin, Fallon, NV (US)

( * ) Notice: Subject to any disclaimer, the term of this patent is extended or adjusted under 35 U.S.C. 154(b) by 0 days.

(21) Appl. No.: 13/799,931

(22) Filed: Mar. 13, 2013

(65) Prior Publication Data

US 2013/0249259 A1 Sep. 26, 2013

Related U.S. Application Data

(60) Provisional application No. 61/612,464, filed on Mar. 19, 2012.

(51) Int. Cl.
*A47C 7/62* (2006.01)

(52) U.S. Cl.
CPC ..... *A47C 7/62* (2013.01)

(58) Field of Classification Search
CPC ..... A47C 7/62
USPC ..... 297/182, 463.1, 463.2
See application file for complete search history.

(56) References Cited

U.S. PATENT DOCUMENTS

| | | | | | |
|---|---|---|---|---|---|
| 2,771,127 | A * | 11/1956 | Cole | 297/182 |
| 2,836,229 | A * | 5/1958 | Spetner | 297/182 |
| 6,022,072 | A * | 2/2000 | Moyer | 297/182 |
| 7,736,711 | B2 * | 6/2010 | Dobelle | 297/182 |
| 8,162,189 | B2 * | 4/2012 | Robins | 297/182 |
| 8,282,161 | B1 * | 10/2012 | Jacobson | 297/188.2 |
| 2010/0148563 | A1 * | 6/2010 | Fera | 297/463.1 |
| 2011/0140490 | A1 * | 6/2011 | Swanson | |
| 2011/0266820 | A1 * | 11/2011 | Hurwitz | 296/1.07 |

* cited by examiner

*Primary Examiner* — Peter Brown

(57) ABSTRACT

The couch catcher; a receptacle accessory that acts as a catcher for coins, keys, remote controls, phones, jewelry and other debris which commonly can fall between the cushions of a couch or chair and into the crevice beyond reach. Design intent is to alleviate the need for the consumer the pesky task of dismantling the couch or chair to retrieve items that have slipped between the cushions or fallen down into the crevice.

1 Claim, 1 Drawing Sheet

COUCH CATCHER

I/we claim priority to my/our Provisional Application Ser. No. 61/612,464 FILED on 2012 Mar. 19

BACKGROUND OF THE INVENTION

1. Field of the Invention

The present invention relates generally to the field of couch accessories and more specifically relates to couch catchers.

2. Description of the Related Art

Many individuals own furniture to rest upon in a residence. This furniture may include chairs, couches, loveseat and the like. A commonplace and annoying occurrence with these upholstered couches and chairs is that when one sits down, there is a high likelihood that coins, keys, remote controls, phones, jewelry or other debris may drop from the individuals pocket and go down into the crevice of the couch or chair. If this is noticed, the cushions (or whatever covering accompanies the couch or chair) have to be removed and the lost items picked up by digging into the crevice of the furniture or by removing the bottom fabric from the couch or chair. Therefore, there exists a need for a device of some sort to prevent the annoyance of small objects from falling into the crevices of a couch or chair.

BRIEF SUMMARY OF THE INVENTION

In view of the foregoing disadvantages inherent in the known furniture accessory art, the present invention provides a novel couch catcher. The general purpose of the present invention, which will be described subsequently in greater detail, is to provide a receptacle accessory that acts as a catcher for coins, keys, remote controls, phones, jewelry or other debris which commonly will slip down between cushions without damaging or altering the design and functionality of the couch or chair. The design intent is to alleviate the consumer of the pesky problem of dismantling the couch or chair to retrieve items that have slipped behind the cushions and into the crevice. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and methods of use for the present invention, the Couch Catcher, constructed and operative according to the teachings of the present invention.

3 Fabric Portion of the Couch Catcher.

4 Velcro attached to the edges of the fabric.

Figure 1:
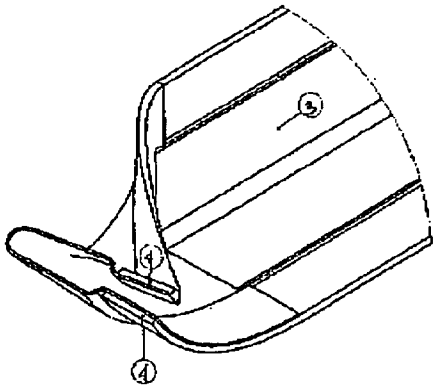
FIG. 1 Shows a close up of the Couch Catcher.
Figure 2:
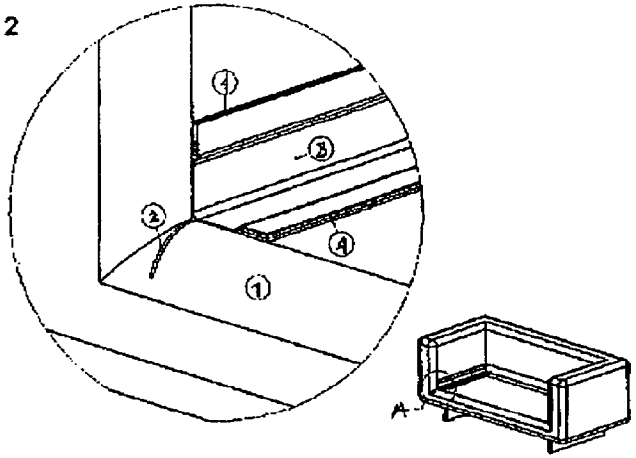

FIG. 2 in the balloon is a close up of the crevice of the couch/chair with the Velcro attached to either side of the crevice.

1 Couch/chair.

2 crevice.

3 Back of couch/chair.

4 Velcro.

Figure 3:
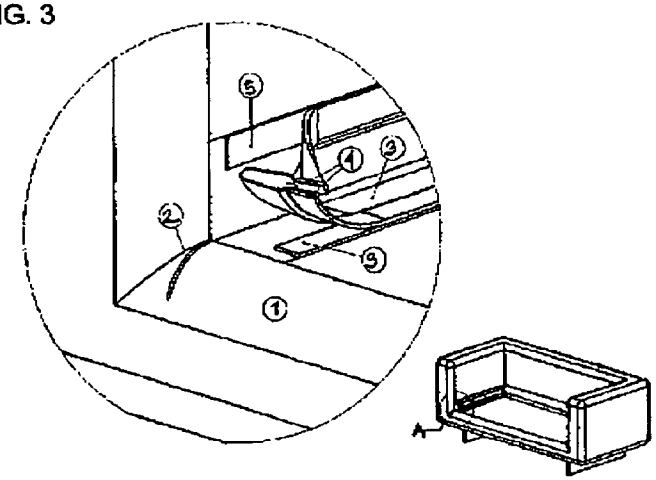

FIG. 3 In the balloon Is a dose up of the Couch Catcher being placed over the crevice.

1 Couch/chair.

2 crevice.

3 Fabric.

4 Velcro attached to the couch/chair on either side of the crevice.

5 Velcro attached to the Couch Catcher.

A. Shows a view of the couch/chair with the Couch Catcher in place.

Figure 4:
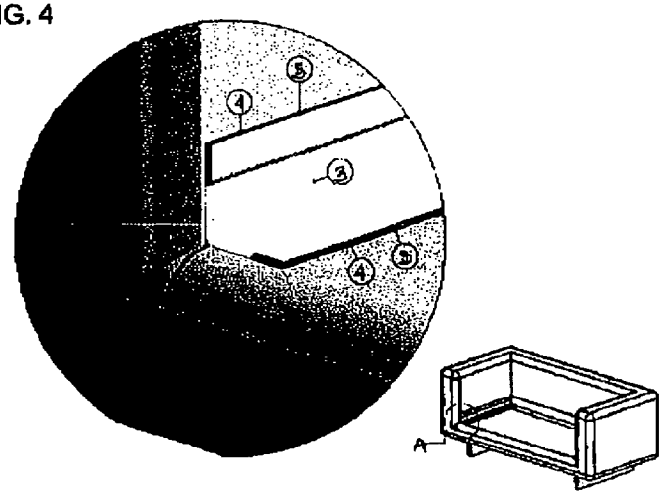

FIG. 4 Shows a dose up of the couch/chair with the Couch Catcher in place and will be completely covering the crevice.

1 Couch/chair

2 Crevice

3 Fabric part of the Couch Catcher.

4 Velcro attached on either side of the crevice.

5 Velcro attached to both the fabric of the Couch Catcher and attached to the Velcro that has already been attached to the couch/chair on either side of the crevice.

A. View of the couch/chair with the completed Couch Catcher in place and completely covering the crevice.

The various embodiments of the present invention will hereinafter be described in conjunction with the appended drawings.

DETAILED DESCRIPTION

As discussed above, embodiments of the present invention relate to a furniture accessory device and more particularly to a Couch Catcher to be used as a catcher for coins, keys, remote controls, phones, jewelry and other debris commonly found in one's pockets. Referring now to the drawings, FIGS. 1-4, show the objective of the present invention is to provide an easier method of retrieval for items falling into an upholstered chair or couch.

The "Couch Catcher" could be marketed in two or more sizes e.g.—couch and armchair; due to varying dimensions of the furniture to be treated. The kit will contain enough Velcro (copyright) to utilize for the application to the piece of furniture to be treated. Inside of the kit will be an ample supply of the cloth to be utilized as the catching area and there could be another packaging that will contain either vinyl or leather, dependent upon the customer's personal preference. The kit will also contain well-prepared and graphically illustrated instructions regarding the application of the Velcro (copyright) and the cloth. The instructions, begins with graphics so that the customer can easily understand the procedure to be followed. The Velcro (copyright) will be attached to the furniture along the lines of sides of the crevice and the cloth, leather or other fabric and attach itself to the Velcro (copyright) that has been adhered to the furniture on both sides of the crevice.

The utilization of this concept will effectively cover over the crevice of the furniture and allow for an easy recovery of the item(s) dropped. With the application of the Velcro (copyright) as per instructions, the "Couch Catcher" cloth will not be visible by having been covered with the seating cushions. Should the piece of furniture need to be cleaned or shampooed, the catching cloth can be easily removed from the Velcro (copyright) strips.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public in general, and especially the scientist, engineers and practitioners in the art who are not familiar with patent or legal terms or phraseology, to determine quickly from a cursory inspection the nature and essence of the technical disclosure of the application.

What is claimed is new and desired to be protected by Letters Patent is set forth in the appended claim:

1. A couch catcher device for use with a piece of upholstered furniture having a horizontal base portion and at least one wall portion extending generally vertically upwardly from the base portion, the couch catcher device being formed of an elongated section of flexible fabric such that it may be folded along its length into a compact size for packaging purposes, the elongated section defined by upper and lower edges extending along the length thereof, and including elongated strips of fabric hook-and-loop fasteners secured to the upper and lower edges, wherein the fabric hook-and-loop fasteners of the lower and upper edges of the couch catcher device are connectable to corresponding strips of hook-and-loop fasteners that are adapted to be secured to the horizontal base portion and the at least one wall portion of the upholstered furniture, respectively, such the couch catcher device forms a generally right-angle seal when secured to the upholstered furniture and does not extend into a crevice between the base portion and the at least one wall portion, to thereby prevent debris from falling into an interior of the upholstered furniture.

* * * * *